United States Patent [19]

Yancey

[11] 4,052,827

[45] Oct. 11, 1977

[54] GROUND ANCHOR AND FOUNDATION SUPPORT

[76] Inventor: Charles R. Yancey, 1322 Hondo St., Lockhart, Tex. 78644

[21] Appl. No.: 686,459

[22] Filed: May 14, 1976

Related U.S. Application Data

[63] Continuation of Ser. No. 545,773, Jan. 31, 1975, abandoned.

[51] Int. Cl.[2] ..... E02D 5/74

[52] U.S. Cl. ..... 52/156; 52/166

[58] Field of Search ..... 52/166, 156, 158, 160, 52/155, 153

[56] References Cited

U.S. PATENT DOCUMENTS 1,504,899 8/1924 Quinn et al. ..... 52/158

FOREIGN PATENT DOCUMENTS 823,336 10/1951 Germany ..... 52/155

*Primary Examiner*—Price C. Faw, Jr.
*Assistant Examiner*—Carl D. Friedman

[57] ABSTRACT

Disclosed is a ground anchor and foundation support device for anchoring various structures to the earth, or for maintaining a desired alignment thereto, or to prevent foundation beams or floor members from sagging by providing support therefor. The device has a strong rigid central body section comprising at its vertical axis, an internally threaded attachment tube, and extending outwardly from the tube, a plurality of quadrilateral, wing-shaped segments, each having a diagonally shaped outer side. At its top, this side is close to the vertical axis of the device, then it flares outwardly to its bottom edge. This side of the segment is provided with an elongate socket which parallels its diagonal shape. A stake or earth auger, which is snugly encompassed by the socket, can be driven through the socket and into the earth. Since the position of each driven stake in the earth is diagonally outward and downward from the central body of the device, then the composite geometry of all the stakes is pyramidal. Also, the number of stakes may vary from two to six, or more. Thus, reasons for the strong resistance of the anchor (and attachments) to any upward or downward movement will be obvious. After driving the stakes, various fastening agents can be affixed or threaded into the attachment tube to serve the structures named in the application.

11 Claims, 7 Drawing Figures

GROUND ANCHOR AND FOUNDATION SUPPORT

This application is a continuation of applicant's copending application, Ser. No. 545,773, filed Jan. 31, 1975, now abandoned.

This invention relates to improvements in ground anchor and foundation support devices used for one or more of the following purposes:

1. As an anchor or tie-down to prevent various structures from being blown from their desired position by high winds. Examples of such items are light prefabricated buildings, mobile homes, recreational vehicles, airplanes, helicopters, etc. In such usages, the buildings, vehicle, or structure would ordinarily be attached to the anchor by bolts, screws, clamps, straps, or the like.

Note: As will be generally understood, the satisfactory anchoring of a building, mobile home, or most structures, could require the use of several anchors, depending on the expected stress.

2. As a support for the floor or foundation members of small buildings, either at localized spots or over larger areas, to prevent sagging or settling of the building — even when it is used for heavy items such as ride-type lawn mowers.

3. As an anchor to be used with bolts, guy wires, or the like to hold posts or towers in a substantially fixed position (ordinarily vertical) despite the pull or stress of cables or wire, pipe lines, and the like, caused by wind, water, gravity, etc. Examples of such usages are poles and towers for telephone or other electronic wires, antenna towers, fence posts, poles for supporting tents, etc.

The invention disclosed herein to serve these purposes in a superior way comprises a strong and rigid vertically positioned central body section preferably composed of a plurality of out-flaring quadrilateral wing-segments rigidly affixed vertically to an attachment tube, or the like, which is more or less axially located, and which normally will be internally threaded. The outer side of each wing-segment has a diagonal shape and carries an elongate snug-fitting socket, through which a stake or earth auger is passed and driven into the earth. These points are emphasized: 1. Because of the axial affixment of the wing-segments around the central attachment tube (or the like), the number of wing-segments and sockets can vary from two to six, or even more. 2. The composite geometry of all the stakes in the earth is pyramidal. Obviously, this combination of multiple stakes embedded pyramidically in the earth can enable whatever strength factor is needed for the particular service.

After the stakes have been driven into the earth, the combination of parts becomes a composite unit which will strongly resist any movement: upward, downward, or lateral. Thus the value of this device as a ground anchor and foundation support is manifest.

It is obvious that the attachment arrangements provided herein can be used very flexibly for linking this anchor/foundation support to beams or floor members, guy wires, straps, posts, etc., so as to serve the structures named above.

Comparisons of the advantages offered by the device covered by this invention as against certain other structures are made herein in the section entitled Detailed Description.

OBJECTS OF THE INVENTION

The improved anchor and foundation support made according to the teaching of this application offers the advantages named below:

It is the principal objective of the invention herein described to provide an economical yet very sturdy ground anchor and foundation support device that can be easily installed by un-trained persons using simple manual tools into soils of a wide range of firmness, such device to provide effective resistance to subsequent movement of the device in any direction: upward, downward, or lateral.

It is also an important objective to provide in such a device convenient, versatile, and adjustable means near its vertical axis for linking it to various structures as listed earlier in this application so as to effectively serve them.

Yet another objective is to provide a basic segmental part for such an anchor/foundation /support enabling various versions to be manufactured using a plurality of substantially similar quadrangular wing-segments, which extend laterally from a rigid, vertically positioned pipe at the perpendicular axis of the device, and are securely affixed thereto. Thus, by varying the number of wing-segments the strength and cost of the device may be substantially adjusted to the needs of a particular service.

Still another objective is to provide in each wingsegment of the device described above, a diagonally shaped outer side and, parallel therewith, an elongate socket which may be affixed thereto — or formed from the base sheet. Through each of these close-fitting diagonal sockets a stake or earth auger may be manually driven into the earth, so that the composite pattern of the stakes in the ground is pyramidal, thus assuring great resistance to subsequent movement of the device, whether used as a ground anchor or as a foundation support.

It is a corollary objective of this invention to provide a ground anchor and foundation support which meets the objectives named above and, at the same time, is so designed that in most of its manufacture, high speed metal fabrication methods such as roll forming (of sockets), projection welding (of socket tab to wing-segments), and progressive die stamping (of wing-segments), may be utilized for low costs and increased strength.

Additional objects and advantages of the invention will be apparent from the following description of an improved ground anchor/foundation support device, manufactured in accordance with the invention, and by reference to the accompanying drawings which illustrate preferred embodiments of the same.

DETAILED DESCRIPTION

Figure 1:
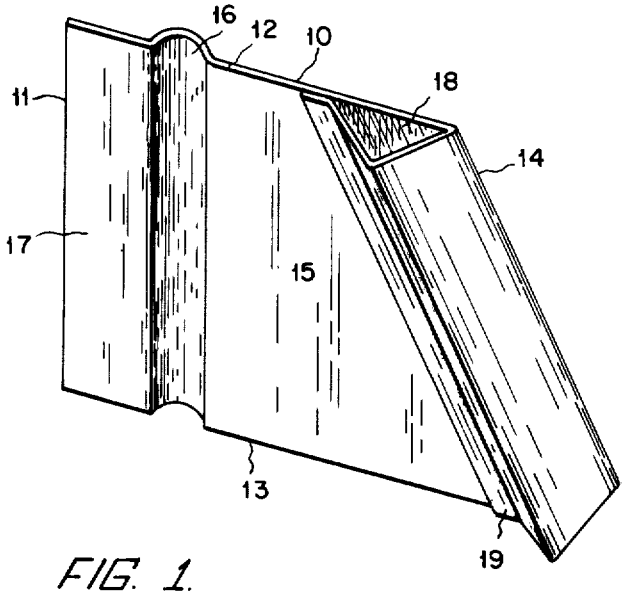
FIG. 1 is a perspective view of a typical anchor wing-segment which, in combination with similar parts, can be used to substantially make up the body of various versions of this improved ground anchor and foundation support.

In greater detail, FIG. 1 shows a wing-shaped segment 10, which in modified forms, is a generic part for the manufacture of various versions of this improved earth anchor and foundation support. The basic shape of a typical wing-segment is quadrilateral, with an attachment side 11 which is vertical, a short top side 12 and a long bottom side 13, so that the fourth side 14 forms a diagonal line between the latter two. This basic shape is important, as will be explained below.

Wing-segments 10 are preferably die-cut from sheet metal to produce a "blank." The blank is then formed by fabricating equipment so that a typical wing-segment comprises a flat body area 15, a curved vertical portion 16, which may be used as a welding tab, or may be contiguous to a joinder tab portion 17, while on the far side of flat area 15, and attached to side 14, is a diagonally positioned stake-socket 18 which carries a socket attachment tab 19 contiguous to and parallel with the socket. Socket tab 19 is welded to body area 15 thus completing one form of socket 18.

Figure 2:
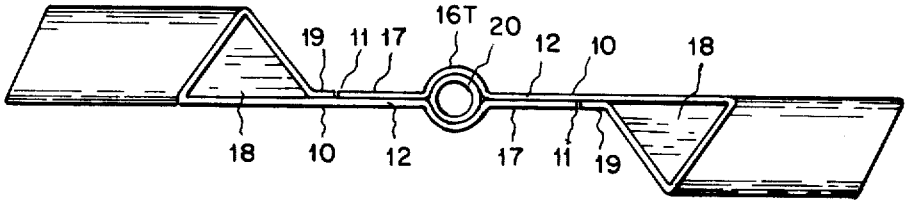
FIG. 2 is a view from above of a two-socket version which uses two of the wing-segments in FIG. 1. An internally threaded attachment tube, or coupling, for attaching other structures to the anchor, is also shown.

As shown by the two-socket version in FIG. 2, two wing-segments 10 can be fitted back-to-back and quickly secured to each other by welding the joiner tab 17 of each segment to the flat body area 15 of the other so as to obtain a substantially complete anchor-body. It will be noted that in so doing a tube 16T is formed by curved portions 16 and 16. Usually, in the upper part of tube 16T there will be inserted a short attachment coupling 20, which normally is internally threaded, and firmly welded within tube 16T.

Figure 3:
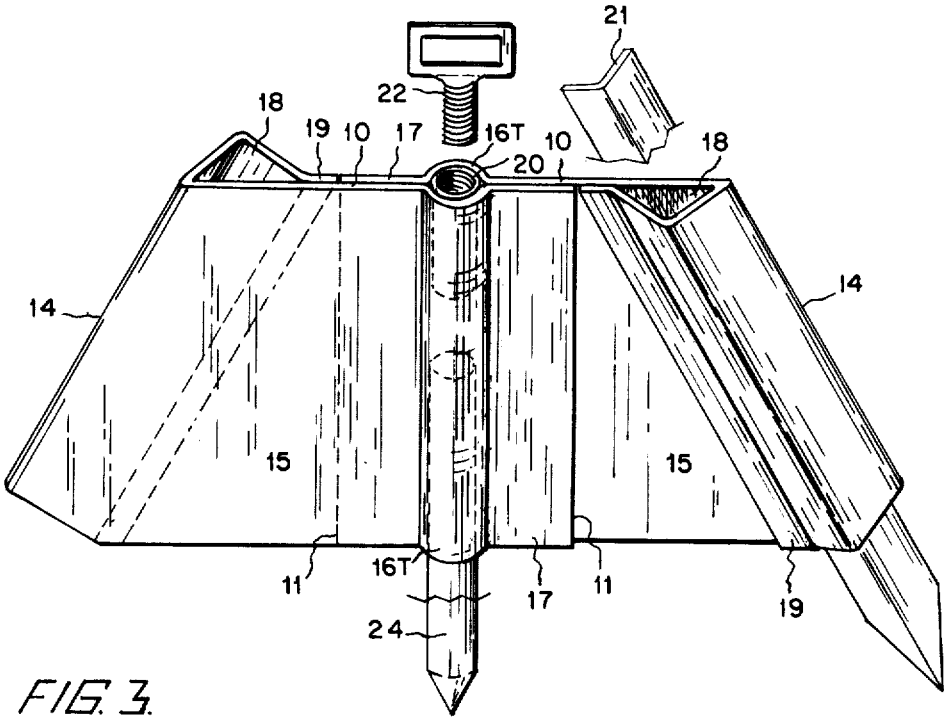
FIG. 3 is a front perspective elevation of the version in FIG. 2. This drawing also shows a type of attachment bolt, a typical stake, and a separate centering pin, the usage of which will be explained later herein.
Figure 6:
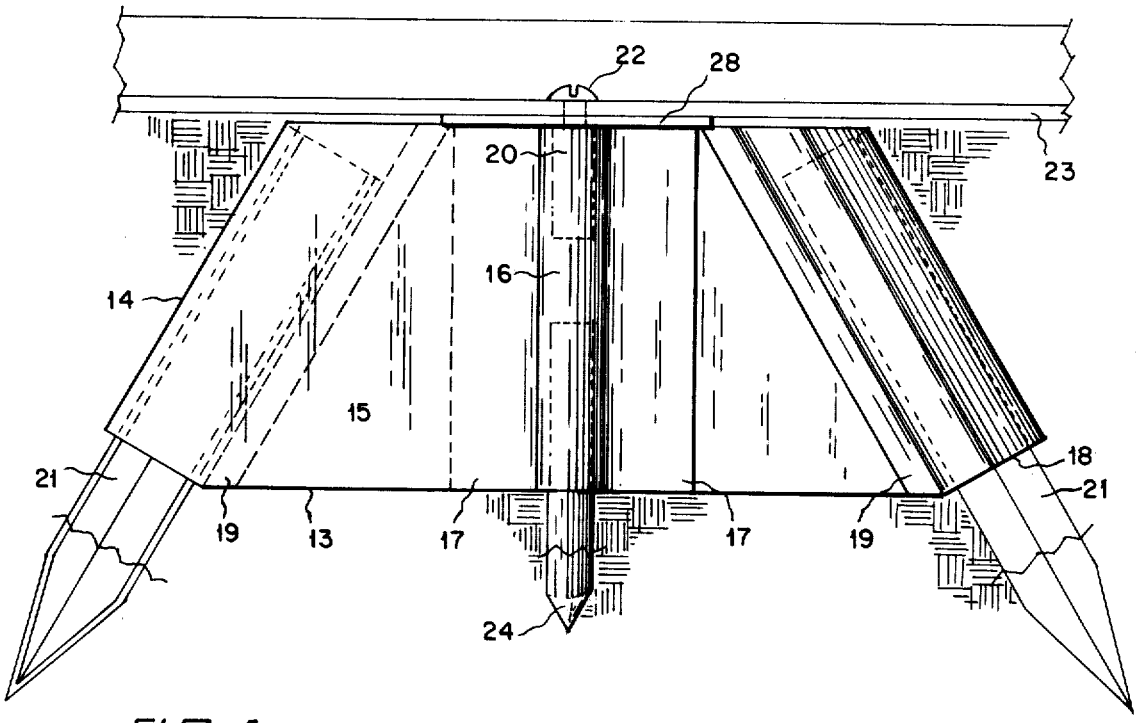
FIG. 6 is a front cut-away view of the version in FIG. 3 as it looks when installed in the earth, with stakes driven through the sockets, and with a typical bolt passing through a fish plate or the foundation beam of a building, and into the attachment coupling of the anchor. This drawing clearly shows the pyramidal pattern of the stakes in the earth.

For small buildings usage, this two-socket version will normally be placed in a shallow trench at a desired location, after which stakes 21 are driven through the contra-directed diagonal sockets 18 to firmly lock the anchor/support device in the ground as illustrated in FIGS. 3 and 6. A bolt 22, or the like, may then be screwed into attachment coupling 20 so as to strongly link this anchor/foundation support to a foundation beam 23, or to other parts, so as to prevent any subsequent movement — upward, downward, or lateral.

Thus, the low cost two-socket version illustrated in FIGS. 2, 3, and 6 is an economical, convenient, and sturdy answer to many of the problems and stresses found in anchoring and supporting small inexpensive prefabricated metal buildings which are widely used nowadays for shelter or storage of lawn mowers, garden equipment, domestic items, etc.

These buildings are usually sold in kits for erection by customers—most of whom lack craft skills and engineering know-how. Consequently, the light-weight structures are frequently assembled on lawn areas with no provisions for resistance to high winds, or means to prevent foundation beams or floor members (if any) from sagging or buckling.

Other problems are found in such buildings—especially in doorway areas when the building is used for riding-type lawn mowers, tractors, etc. The passage of such heavy equipment imposes stresses upon adjacent beams and floors causing jamming of the door, sagging of beams, and buckling of the floor. Obviously, selective placement of this anchor/support device will help to withstand these heavy loads. Thus, attachment bolt 22 may be used to affix a head-plate 28 (as in FIG. 6) onto the device to spread its support over a wider area. Also, a fabricated headplate 28 may function as a fish-plate at corners of the building to rigidly connect intersecting foundation beams and hold them at fixed 90° angles.

The two-socket version of this device also offers a simple solution to another problem in the erection of such buildings: The squaring of the corners. In this usage, after the site has been reasonably levelled, the approximate "corners" of the building will be determined. At each of these, a small slit trench (approximately 7 inches long by 2 inches wide x 4 inches deep) will be dug diagonally across the approximate corners. Then, a separate centering pin 24 (which is ordinarily, a short pointed wooden dowel) will be driven at the precise 90° point of each corner.

Next, an anchor body will then be set into each corner by slipping tube 16T over centering pin 24. Since tube 16T, and attachment coupling 20 are axially located in the anchor-body, it will be obvious that when attachment bolt 22 is passed through mating holes in the ends of foundation beams 23, exact 90° "corners" of the building may be easily determined and firmly maintained by using the immovable ground-anchors disclosed herein.

Of further assistance in the setting of "corners" for such buildings is the fact that a socket 18 is located on one side of the anchor, while the other socket is on the reverse side, as shown by FIGS. 2 and 3. Hence, a stake 21 (as in FIGS. 3 and 6) may be driven through one socket, while another stake is being driven through the other without interference between the two.

Thus, by alternately striking the end of first one stake, then the other, the anchor-body is not subjected to "anchordrift" (the tendency of the anchor-body to move horizontally in the general direction of the hammer blows) such as happens when an initial stake is driven all the way home before the driving of another is started. Such "drifting" must be prevented when setting exact corners for small buildings. An additional preventive of such drifting is the embedded centering pin 24, as described above.

Another use for which this improved ground anchor is adapted is for tying down small airplanes, helicopters, recreational vehicles, etc. For these services the two-socket version will preferably be used because of its lighter weight and relatively flat shape. In this usage the sockets 18 will preferably be round, and cork-screw type earth augers will be used instead of straight stakes 21. The anchor for this service will normally have wide bottom flanges attached to side 13 so that the device can be simply set on the ground at a selected spot. Following this, a cork-screw auger 21 will be dropped through each socket 18, and drilled into the ground. An eye-bolt 22 will then be screwed into the attachment coupling 20 of the anchor so that a rope or strap can be passed through it and affixed to a ring or other fastening arrangement on the vehicle. When desired, the anchor may be easily removed by un-screwing the augers.

Figure 4:
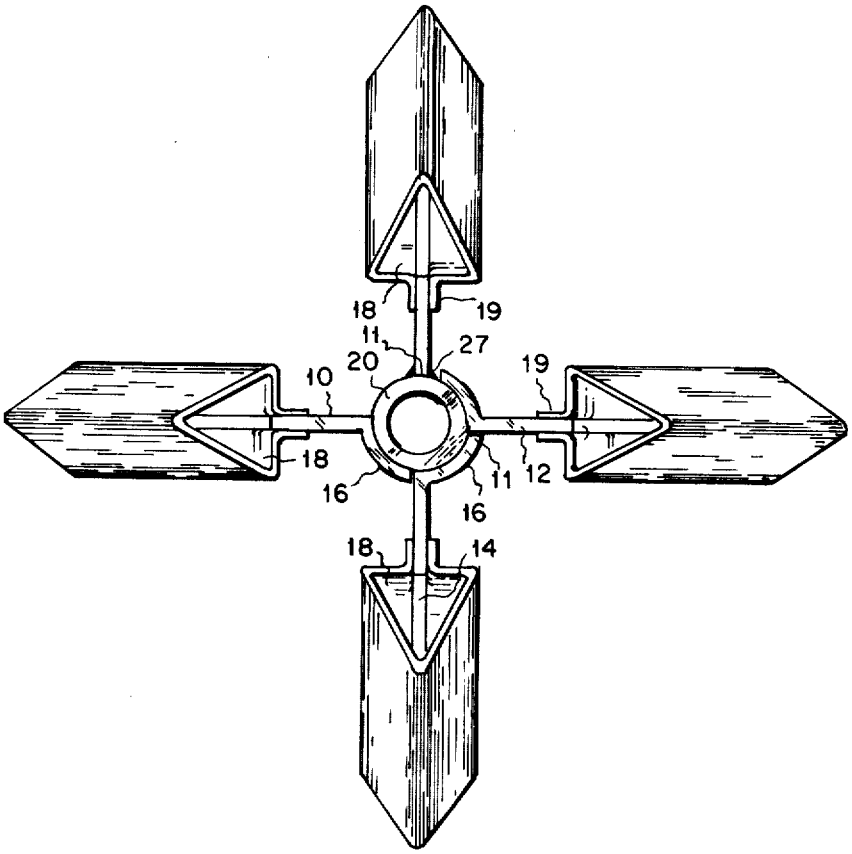
FIG. 4 is a view from above of a four-socket version which uses modified forms of the wing-segment in FIG. 1. The topmost wing has a plain-cut attachment side; while the other three have a curved attachment side. The drawing also shows a variation in design of the stake-sockets.
Figure 5:
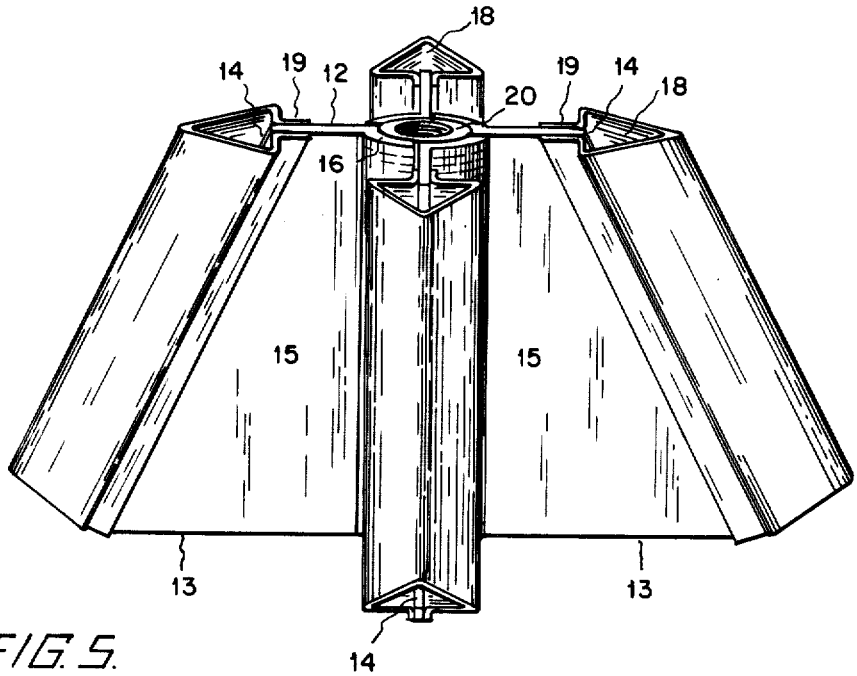
FIG. 5 is a perspective elevation of FIG. 4.

For extra heavy stresses (such as tying down a large mobile home or supporting heavy poles or towers) it is recommended that a multi-wing version be used. FIGS. 4 and 5 show a four-socket type, but it will be realized that the provision of three, five, or more sockets is entirely practicable using the basic segmented principle of the anchor/foundation support described herein.

Referring to FIG. 4, distal wing-segments 10 will ordinarily be spaced symmetrically around a strong, axially positioned attachment coupling 20 (or the like) which, in this version, will usually extend from top to bottom of the anchor-body. The vertical side 11 of wing-segment 10 may have a plain-cut attachment edge 27, as shown by the topmost wing-segment in FIG. 4, or it may be provided with a curved joinder tab 16, as shown by the other three wings. The curved tab 16 is designed for affixing the wing to attachment coupling 20 by resistance welding, whereas the plain edge 25 is designed for arc welding.

FIG. 4 shows plainly the expansible character of the construction which is made possible by generic wing-segment 10. Obviously, the number of wing-segments 10 that may be affixed to coupling 20 can easily run from two to six, or more if desired. Each wing, of course, carries its own stake-socket 18, and its own stake 21.

Yet regardless of the number of wing-segment used—each of which contributes to an increase in the pull-up, or support capabilities of the device—the balanced concentration of power at the axis of the device is not adversely affected. The importance of these items in varied applications will be explained further herein.

FIGS. 4 and 5 also show a different form of socket 18 which may be separately fabricated, then affixed to the outer diagonal side 14 of wing-segment 10. This socket-form, and others, may readily be produced and cut to desired length by modern roll-forming and cut-off machinery. Assembly of this socket 18 to the diagonal edge of wing-segment 10 can also be quick and cheap—using projection welding methods.

For many installations where the multi-winged version is used only as a tie-down, it is not necessary to dig a small hole for the anchor-body, unless the installer so desires. In such event, the procedure is quick, as the hole need be only slightly larger than the anchor-body, and the replaced earth requires no tamping. Generally, however, the multi-winged version can simply be set on the top of the ground. In either case, the anchor-body is placed where desired, and stakes 21 are driven through sockets 18. The "anchor-drift problem" is not involved in this type of usage, as maintenance of an exact location is not necessary. Therefore, each stake may be driven home, one at a time, so as to avoid interference with the others.

As with the two-wing version, after driving the stakes, an attachment linkage 22 can be affixed to the anchor body, or to coupling 20. However, because of the much greater strength factors of the multi-wing versions, many types of linkage hardware may be used. Indeed, the type of hardware will depend largely upon the final purpose: adjustable strap-buckles for mobile homes; clevis or swivel heads for direct linkage to the legs of play-swings or drilling platforms; rings or turnbuckles for guy-wire support of poles and towers; pipe-type building columns screwed directly into coupling 20; fence posts or utility poles dropped into an unthreaded coupling 20, and secured therein by a bolt passed through mating holes in both pieces; use of a short threaded pipe column, with welded plate thereon, for screwing into coupling 20 to adjustably support a mobile home, etc.

A principle advantage of multi-socketed versions is found in their ability to anchor or tie down mobile homes etc. in a wide range of soils without requiring heavy power-driven equipment as well as expensive contractor-operators.

In other words, by using the ground anchor disclosed herein, an un-trained do-it-yourself mobile home owner may select an anchor having the number of stake-sockets which is best adapted to the type of soil on which his home rests.

For example: To obtain a desired pull-up resistance or support, a loose, sandy loam may require an anchor/foundation support with five or six stake-sockets; whereas a firm, clay soil may require only three.

In any case, using only a heavy sledge hammer, this person can manually drive the required stakes into the anchor disclosed herein to obtain whatever resistance or support factor that may be desired. Each stake, by itself, may appear weak but, in the aggregate, a total strength will be obtained, that will exceed the strength of competitive devices—and at lowest possible installed cost.

For a greater understanding of the essential functions of a ground anchor and foundation support device the following statements are made:

1. The ultimate value of such a device rests upon its abilities:
   a. As a ground anchor: It must provide superior resistance to being pulled out of the ground (whatever the type of soil may be) or loosened by high winds or other stresses.
   b. As a foundation support: It must strongly resist downward or lateral pressures.
2. The kind of soil into which an anchor/support device is installed will affect in varying degrees its performance—as well as the work required to install it. It is hardly necessary to state that, as to soils, a desirable anchor:
   a. Should be easily installable in a wide range of soils—from loose to those that are firm and compact. Obviously, it should not be necessary (1) to dig a hole for the anchor, (2) then subsequently replace the soil, as such "disturbed earth" loses much of its original retentive power even if it is tamped.
   b. Also, it should not be possible to pull up the device except by displacing a great amount of soil. This ability is much more desirable than types that can only displace a much lesser amount.
   c. A superior anchor should offer simple modifications that enable it to provide whatever strength-factor is needed for a particular installation. This would include the ability to compensate for a soil of poor retentive or support power.
3. For these reasons, the central stem or body of a superior ground anchor/support device should have extended parts which reach out substantially, both laterally and vertically, into surrounding undisturbed soil. And, if such extensions are strongly and rigidly affixed to the central body then it is obvious that the resistance of the device to pull-up or to settling will be greatly increased.

4. Moreover, if the device (in all its strength factors) can be manually installed by an un-trained person with simple tools (as against other devices that can only be installed for adequate strength by powder-driven machinery) then substantial installation costs will be avoided.

Tests, show that a ground anchor/foundation support constructed according to the teaching of this invention will meet all of these requirements in a unique and very satisfactory way. The extended parts for the device are the stakes 21 which may easily number as many as six or more for a single anchor. Each rigidly held stake may be as long and as heavy as desired, and it can be driven into undisturbed soils of a wide range of firmness. Also, since the installed direction of each stake is oblique, it can be driven deeply, and also in a wide lateral extension. Finally, because all the stakes are driven to conform to an outspread pyramidal pattern, the device is strongly resistant to movement or stress from any direction. In fact, it is akin to a strongly rooted tree.

As to the strength and rigidity of attachment between the stake-socket and the central body, attention is directed to the fact that each elongate socket 18 is integrally supported along its entire length by body portion 15. The length of this support is approximately four times greater than that which would be obtained by simply welding two socket tubes across each other, at their limited intersection.

The length of this strong joinder for socket 18 is very important, as any upward stress (as from a wind-storm), or downward thrust (as from heavy loads) will necessarily impose a bending force on any oblique stake device. The shorter the length of joinder, the greater the leverage on the socket will be.

Likewise, the strength and rigidity of socket 18 is essential if stake 21 is to fulfill its purpose. Therefore, it is emphasized that each socket 18 completely and snugly encases not only the girth of stake 21 but, also a material part of its length. This close, strong, and elongate fit is important as it is assurance that the entire anchor-body, and the pyramidally positioned stakes, will become a single compact and integrated unit for resisting subsequent movement of the device in any direction.

Figure 7:
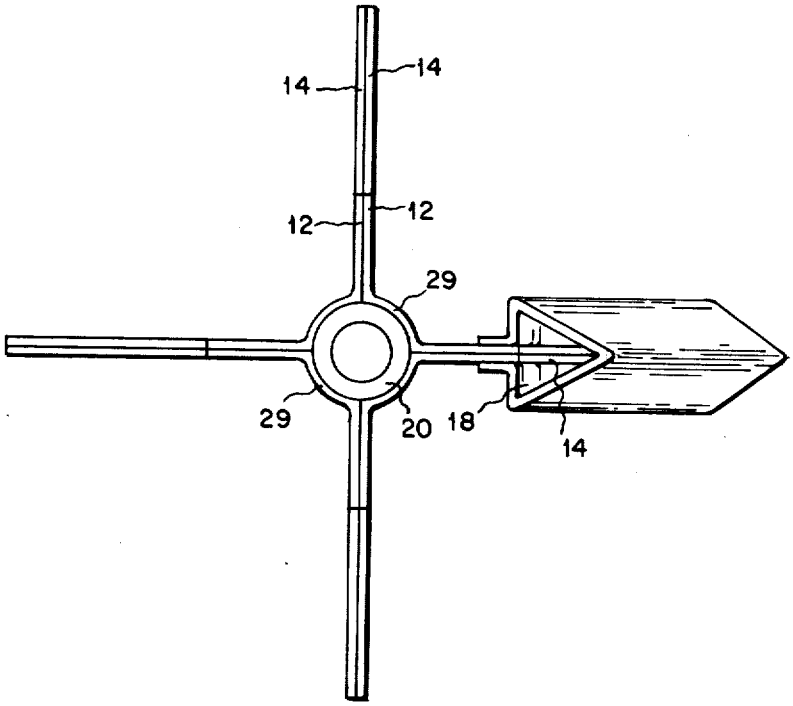
FIG. 7 is a view from above showing a modification of FIG. 4. This anchor uses double-wing segments, each half of which is like the generic segment, but allows the double-wing segments to be welded back-to-back for greater strength.

Commenting on FIG. 7, it is emphasized that the construction therein is not a departure from the generic nature of wing-segments 10. The wings shown in FIG. 7 are double-segments, connected to coupling 20 by a variation 29 of curved tab 16. The double-wing segments can be stamped from comparatively thin sheet metal which, after being welded back-to-back and to coupling 20, will be about as strong as a thick heavy sheet that might require a slow and more expensive arc welded joinder to coupling 20.

Among competitive devices in prior art literature, and in commercial use are the following:

1. The earth screw anchor: This device has a central shaft with one or more outstanding blades, each of which is formed and inclined so that, under certain conditions, when the shaft is turned, it will bore its way into the ground. However, the device must be driven deeply into the soil if it is to assure substantial resistance to pull-up. Unfortunately, even in soft soils, the turning of the shaft requires two or three strong men. Indeed, as a general rule, an earth screw can only be installed deeply into most soils by power-driven machinery. Furthermore, if the soil is very compact, the device cannot be forced into such earth at all—even by the use of heavy machinery.

2. The stanchion: This is a box-like device that is set into a hole laboriously dug into the earth, after which the soil must be repacked and tamped. Alternatively, concrete may be poured into the hole requiring more work. In any event, the device has no extensions that reach out into undisturbed soil, so tht both its tiedown and support strength is limited by undependable disturbed earth, or the weight of the concrete.

3. The rod-and-plate anchor: This device, has a vertical rod to which a horizontal plate is attached. Like the stanchion, it requires the digging of a hole, insertion of the plate, and the replacement of soil, or the pouring of concrete. Its anchoring strength, too, is limited like the stanchion. 4. The flared-vane anchor: This device requires the digging of a hole—through the diameter of the hole can be small. It comprises a shaft and a pair of metal vanes which are parallel with the vertical shaft. A screw arrangement is provided so that in theory as the shaft is rotated, the vanes flare outwardly and grip the earth. In practice, the gripping power in medium to firm soils is very limited.

Having discussed the drawings in specific detail, the following general alternatives are pointed out as being in the spirit of the invention:

a. Though it is preferred that the body portion of this device be composed of a vertically positioned coupling 20, which is more or less centrally located, and a plurality of wing-segments 10 attached thereto, and with sockets 18 provided on the outer side of segments 10, it will be understood that the body could be shaped like a truncated cone (either solid, or as a hollow shell)—with the stake sockets affixed to the outer inclined surface thereof. Thus when stakes are driven through the sockets, their combined pattern in the earth will be pyramidal, as with the preferred form. The truncated cone body could be made of drawn sheet metal, or it could be solid, as of concrete.

b. Though the drawings show triangular sockets 18, it is obvious that they can be round, square, rectangular, channel-shaped, I-shaped, etc., for various applications and to facilitate manufacture. Alternatively, in all versions of this device, they may be formed integrally from the base sheet, or can be separately fabricated, then welded to the diagonal edge of the wing-segment. In whatever form, it will be understood that the shape of the socket interior should conform closely to the outer shape of the stakes or earth auger 21 so as to assure the snug fit that is desired.

c. It will also be understood that a hole, eye-bolt, or the like, can be provided in the top end of a stake for pulling it from the ground.

d. The lateral strength of wing-segment 10 in the preferred form may be increased by such means as: (1) Providing marginal areas in the die-cut blank above top side 12 and below bottom side 13, and folding them at approximately 90° as flanges; (2) pressing or forming ribs or grooves laterally in flat area 15; also (3) wing-segments 10 may be welded back-to-back, as in FIG. 7; or (4) add-on parts may be welded to the top or bottom of the anchor-body for additional strength, or use. An example is the reinforcing plate 28 in FIG. 6.

e. For brevity, the term "welded" is used frequently herein. It will be understood, of course, that the term covers all practicable welding processes and other methods of affixing or attachment.

It is understood that the foregoing description of the invention is explanatory only and that the forms of the invention, herewith shown and described, are to be taken as preferred examples of the same, and that various reasonable changes in the shape, arrangement, or augularity of various parts, and in means for linking or affixing the device herein to other structures may be made without departing from the spirit of the invention, or from the scope of the subjoined claims:

What is claimed is:

1. An improved ground anchor and support device of the type having a body portion and drivable anchoring stakes affixable thereto wherein the improvement comprises: a body portion including: a centrally disposed elongate vertically positioned tubular core, the height of said core being a plurality of times its diameter, and a plurality of vertically positioned wing segments, radiating outwardly from the tubular core, in a symmetric spacing, said wing segments being each substantially quadrangular in shape, and having top, bottom, inner and outer sides; the inner side of each wing segment being fixedly secured to the periphery of said tubular core for substantially the entire height of both of said members, the wing segment having a short top side, and a relatively long bottom side, both of which extend at substantially right angles from the inner perpendicular side, so that the outer side slopes outwardly and downwardly from the top corner to the bottom corner of the wing segment, said outer side having means providing an elongate tubular socket sleeve along its marginal areas for substantially the entire length of such outer side, and the short top side being only wide enough to provide adequate room for the upper end of the tubular sleeve, each of said tubular socket sleeves forming snug and elongate support means for receiving an anchoring stake driven through the socket sleeve from top to bottom and into the ground surrounding the anchor body, so that the plurality of the stakes lend their unified strength to the anchor body so as to resist any force that tries to move the anchor from its position in the ground, and means on the central core for affixing appropriate attachment hardware to said central core for fastening structures thereto.

2. A device of the character set forth in claim 1 wherein the tubular central core is internally threaded to provide means for attachment of hardware adjustably thereto.

3. An improved ground anchor and support device of the type having a body portion and drivable anchoring stakes affixed thereto wherein the improvement comprises: a body portion including: a centrally disposed elongate vertically positioned tubular core having a vertical axis and a height at least three times its diameter, and a plurality of vertically positioned flat substantially quadrangular wing segments which extend outwardly along radial lines from the vertical axis of the tubular core, each wing segment having a top, a bottom, an inner and an outer side, and being fixedly secured along its inner side to the periphery of said tubular core for substantially the entire height of both members, and having the outer side of each wing segment extending divergently downward with respect to its vertical inner side, and means forming an elongate tubular socket sleeve fixedly disposed along the outer side marginal area of the segment for substantially the entire length of said outer side, the width of the top side of the wing segment being great enough only to accomodate the top of the tubular socket sleeve, and the width of the bottom side of the wing segment being adequate to provide an outward and downward angle of the socket sleeve with respect to the core, said socket sleeve providing snug and elongate support means for an anchoring stake driven through the socket sleeve and diagonally into the ground surrounding the anchor body to secure the anchor support device against movement in the ground, and means on the central core for fastening other structures thereto.

4. An anchor and support device of the character set forth in claim 3 wherein the means for fastening structures to the tubular central core comprises internal threading of the elongate tubular core for receiving externally threaded elongate members.

5. A device of the character set forth in claim 3 wherein the tubular socket members are formed in a substantially triangular cross-sectional configuration and are fixedly secured along the outer side of the wing segments, for receiving the stakes.

6. A structure according to claim 5 wherein the elongate stakes have a generally triangular configuration adapted to fit closely within the triangular tubular socket members for securing the anchor-support device to the ground.

7. A ground anchor and support device comprising: body means including an elongate vertical tubular core having a central longitudianl axis a plurality of lateral wing segments each connected at one end to said core and each having a tubular socket member connected to its other end; said elongate vertical tubular core having a length a plurality of times greater than its diameter; said plurality of radially laterally extending wing segments each having its inner edge portion connected throughout its full length to substantially the full length of the tubular core and having its outer edge portion downwardly divergent from the axis of the core, each tubular socket member being connected throughout its entire length to the length of the outer portion of its respective laterally projecting wing segment and having its longitudinal axis disposed in a plane parallel to the longitudinal axis of the tubular core and extending from a position at one end near the core divergently outwardly from the core at the opposite end of said socket member, said socket members providing means for receiving anchoring stakes extending through the tubular socket members adapted to be driven into the ground for fixedly securing the device against movement with respect to the ground.

8. A ground anchor and foundation support device comprising: a body portion having including an elongate tubular central core having central longitudinal axis and two or more substantially planar wing segments projecting laterally from said core with each of said wing segments lying in a plane common with the longitudinal axis of said core; means providing an elongate socket sleeve along the end portion of each wing setment spaced from said central core of said body portion and disposed to extend in an outwardly divergent direction from one end of said central core and the opposite socket sleeve to the other end thereof; the inner end of each wing segment being secured throughout its entire length longitudinally to the central core of the device and each socket sleeve being secured throughout its entire longitudinal length to its respective wing segment; said central core having a length a plurality of times greater than its diameter; and an elongate fastening means extending through each of the tubular socket sleeves from the end thereof nearest the axis of the central core through the bore of the tubular socket sleeve and beyond the divergent ends of the tubular socket sleeves and adapted for engaging the ground to hold the body portion against displacement from a fixed position on the ground.

9. A ground anchor and support device comprising: body means including an elongate vertical tubular core having a central longitudinal axis, a plurality of lateral wing segments each connected at one end to said core and each having means providing a tubular socket member along its other end portion; said elongate vertically positioned tubular core having a length a plurality of times greater than its diameter; said plurality of radially laterally extending wing segments each having its inner edge portion connected throughout its full length to substantially the full length of the tubular core and having the socket member along its outer edge portion extending downwardly divergently from the axis of the core; each tubular socket member extending along the entire length of the outer end portion of its respective laterally projecting wing segment and having its longitudinal axis disposed in a plane parallel to the longitudinal axis of the tubular core and extending from a position at one end near the core divergently outwardly from the core at the opposite end of said socket member, said socket members providing means for receiving anchoring stakes extending through the tubular socket members adapted to be driven into the ground for fixedly securing the device against movement with respect to the ground.

10. A ground anchor and support device comprising: body means including an elongate vertical tubular core member having a central vertical longitudinal axis, a plurality of laterally extending wing segments each connected at one end to said core member and each having at its other end means providing a tubular socket member, said vertically positioned tubular core member having a length a plurality of times greater than its diameter; said plurality of radially laterally extending wing segments each having its inner edge portion connected throughout its full length to substantially the full length of the tubular core member and having its outer edge portion downwardly divergent from the axis of the core member with the means forming said tubular socket members extending throughout the entire length of the outer portion of said laterally projecting wing segment with the longitudinal axis of said socket member disposed in a plane parallel to the longitudinal axis of the tubular core member; said socket members providing means for receiving anchoring stakes extending through the tubular socket members and adapted to be driven into the ground for fixedly securing the device against movement with respect to the ground.

11. A ground anchor and foundation support device comprising: a body portion including an elongate tubular central core member having a central longitudinal axis and two or more substantially planar wing segments projecting laterally from said core member with each of said wing segments disposed in a plane common with the longitudinal axis of said core member; means providing an elongate socket sleeve at the end of each wing segment spaced from the central core of said body portion, each of said socket sleeves being disposed with one end located adjacent one end of the central core member and extending divergently outwardly with respect to the core member from such one end to the opposite end of said socket sleeve; said central core member being secured substantially throughout its entire length longitudinally to the inner end of each wing segment of the body portion of the device, and each socket sleeve extending throughout its entire longitudinal length along the end of its respective wing segment spaced from the core member; said central core member having a length a plurality of times greater than its diameter; and an elongate fastening means extending through each of the tubular socket sleeves from the end nearest the central core through the bore of the socket sleeve and beyond the divergent ends of the socket sleeves and adapted for engaging the ground to hold the body portion against displacement from a fixed position on the ground; and means on said central core member for fastening structures thereto.

* * * * *